US008342739B2

(12) United States Patent
Gigandet et al.

(10) Patent No.: US 8,342,739 B2
(45) Date of Patent: Jan. 1, 2013

(54) HOROLOGICAL MOVEMENT COMPRISING A HIGH OSCILLATION FREQUENCY REGULATING DEVICE

(75) Inventors: Christophe Gigandet, Le Locle (CH); Francisco Dias, Fleurier (CH); Armin Behrend, Les Verriéres (CH)

(73) Assignee: Chopard Technologies SA, Fleurier (CH)

( * ) Notice: Subject to any disclaimer, the term of this patent is extended or adjusted under 35 U.S.C. 154(b) by 372 days.

(21) Appl. No.: 12/341,625

(22) Filed: Dec. 22, 2008

(65) Prior Publication Data

US 2009/0168610 A1 Jul. 2, 2009

(30) Foreign Application Priority Data

Dec. 27, 2007 (CH) ..... 2018/07

(51) Int. Cl.
*G04B 15/00* (2006.01)

(52) U.S. Cl. ..... 368/129; 368/127

(58) Field of Classification Search ..... 368/124–131
See application file for complete search history.

(56) References Cited

U.S. PATENT DOCUMENTS

| | | | | |
|---|---|---|---|---|
| 3,599,423 | A * | 8/1971 | Beguin et al. | 368/171 |
| 3,805,513 | A * | 4/1974 | Theurillat | 368/124 |
| 4,363,553 | A * | 12/1982 | Thomi et al. | 368/140 |
| 7,905,665 | B2 * | 3/2011 | Moriarty et al. | 385/89 |
| 2010/0002548 | A1 * | 1/2010 | Hessler et al. | 368/129 |

FOREIGN PATENT DOCUMENTS

| | | |
|---|---|---|
| CH | 174391 | 1/1935 |
| CH | 358036 | 6/1956 |
| CH | 408786 | 11/1965 |
| CH | 547 516 | 10/1973 |
| EP | 1736838 A1 | 12/2006 |
| FR | 892533 | 4/1944 |
| FR | 1496479 | 10/1966 |
| FR | 2162504 | 7/1973 |

OTHER PUBLICATIONS

Search Report of European Patent Office relating to European Patent Application No. EP 07 02 5149, Sep. 15, 2008.
Data sheet from "Fabrique d'ebauches, chronographes et rattrapantes Valijoux SA", Calibre Nov. 9, 1968, 4 pages.
Data sheet from "Fabrique d'ebauches, chronographes et rattrapantes Valijoux SA", Calibre 7740/7741, 1976, 2 pages.
Formulaire Technique et Aide-Memoire pour l'Horlogerie et la Petitie mecanique, 1929, p. 168.
European Search Report in corresponding European Application No. EP 11 00 0483, dated Mar. 25, 2011.
European Search Report in corresponding European Application No. EP 11 00 0484, dated Mar. 29, 2011.

* cited by examiner

*Primary Examiner* — Sean Kayes
(74) *Attorney, Agent, or Firm* — Bacon & Thomas, PLLC

(57) ABSTRACT

The horological movement comprises a regulating device having an oscillation frequency f and an escapement (11, 12) for maintaining the oscillations of the regulating device. The escapement comprises an escape wheel (11) having N teeth. The frequency f is at least equal to about 5 Hz, and the ratio between the number N of teeth and the frequency f is substantially equal to 5.

8 Claims, 2 Drawing Sheets

HOROLOGICAL MOVEMENT COMPRISING A HIGH OSCILLATION FREQUENCY REGULATING DEVICE

Figure 1:
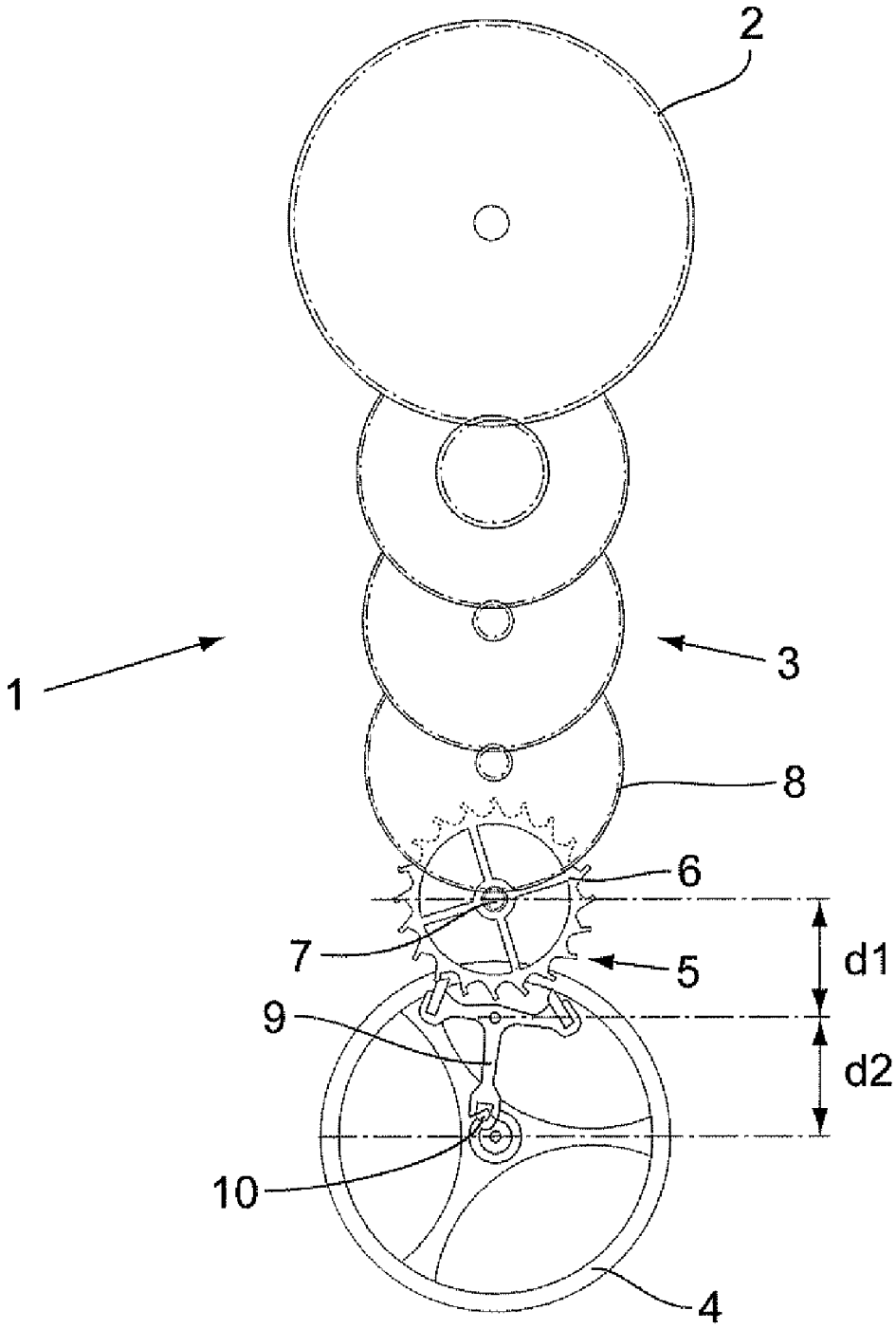

The present invention relates to a mechanical horological movement.

Generally, mechanical horological movements notably comprise a barrel which houses a motor spring, a wheelwork driven by the barrel, a regulating device such as a sprung balance, and between the wheelwork and the regulating device an escapement for maintaining the oscillations of the regulating device. The arbors of certain wheels of the wheelwork bear indicator hands. The escapement comprises an escape wheel driven by the wheelwork as well as an element such as an anchor situated between the escape wheel and the regulating device.

The horological movements that currently exist on the market usually have a regulating device oscillating at a frequency of 4 Hz and an escape wheel having 20 teeth. There has also been commercialized under the trademark Zenith El Primero a movement whose regulating device oscillates at a frequency of 5 Hz and whose escape wheel to applicant's knowledge has 21 teeth.

It is known in the horological field that the higher the frequency of the regulating device the more precise time measurement is. However, an increase in frequency causes an increase in the angular speed of rotation of the escape wheel thus necessitating a modification of the wheelwork and more precisely of the gear ratios so that the indicator hands turn at the right speed. An increase in the speed of rotation of the escape wheel has the further effect of reducing the power reserve, since the motor spring will then be released more rapidly.

The present invention aims at proposing an horological movement that can function at a high frequency without having the disadvantages mentioned above.

To this end, an horological movement is provided that comprises a regulating device having an oscillation frequency f and an escapement for maintaining the oscillations of the regulating device, the escapement comprising an escape wheel with N teeth, wherein the frequency f is at least equal to about 5 Hz and the ratio between the number N of teeth and the frequency f is substantially equal to 5.

The frequency f is preferably at least equal to about 6 Hz, more preferably at least equal to about 8 Hz, and still more preferably at least equal to about 10 Hz.

Thus, in the present invention the frequency of the regulating device is increased without modifying the ratio between the number N of teeth of the escape wheel and the frequency f, this ratio having a usual value. The angular speed of rotation of the escape wheel thus remains unchanged, so that the wheelwork and more generally the entire movement except the regulating device and the escapement may remain unchanged. The power reserve is preserved as well.

To the same end as indicated above, the present invention also provides for at least two horological movements, one comprising a regulating device having an oscillation frequency f1 and an escapement for maintaining the oscillations of the regulating device, the escapement comprising an escape wheel having N1 teeth, the other comprising a regulating device having an oscillation frequency f2 and an escapement for maintaining the oscillations of the regulating device, the escapement comprising an escape wheel having N2 teeth, wherein the numbers N1 and N2 of teeth are different, the frequencies f1 and f2 are different, and the ratio between N1 and f1 is substantially equal to the ratio between N2 and f2.

Both movements typically further comprise respective wheelworks with which the escape wheels respectively cooperate. Advantageously, the wheelworks are substantially identical.

The escapement in each movement typically further comprises an anchor located between the escape wheel and the regulating device. Advantageously, the distance between the centers of rotation of the escape wheel and of the anchor is substantially the same in both movements, and the distance between the centers of rotation of the anchor and of the regulating device is substantially the same in both movements. In this way the plates and bridges supporting the various elements may be the same in both movements.

Both movements may even be substantially entirely identical, except for their escapement and their regulating device.

Said ratios between N1 and f1 and between N2 and f2 are typically substantially equal to 5. Preferably, at least one of the frequencies f1 and f2 is at least equal to about 5 Hz, preferably at least equal to about 6 Hz, more preferably at least equal to about 8 Hz, and still more preferably at least equal to about 10 Hz.

It will be noted that the present invention makes it possible to design sets of regulating device and escapement that are different and interchangeable so that horological movements having a same design may function at different frequencies. In other words, a common base may be designed for a number of movements, and for each of them a regulating device—escapement set may then be selected to make it work at a desired frequency.

Thus, the present invention also proposes a method for changing the oscillation frequency in an horological movement comprising a first regulating device having an oscillation frequency f1 and a first escapement for maintaining the oscillations of the first regulating device, the first escapement comprising a first escape wheel having N1 teeth, wherein the first regulating device and the first escapement are replaced by a second regulating device having an oscillation frequency f2 and a second escapement, the second escapement comprising a second escape wheel having N2 teeth, and wherein the frequencies f1 and f2 are different and the ratio between N1 and f1 is substantially equal to the ratio between N2 and f2.

The horological movement typically further comprises a wheelwork with which the first escape wheel cooperates. Advantageously, this wheelwork is kept unchanged so that it cooperates with the second escape wheel after the first regulating device and the first escapement have been replaced by the second regulating device and the second escapement.

Typically, the first escapement further comprises a first anchor located between the first escape wheel and the first regulating device and the second escapement further comprises a second anchor located between the second escape wheel and the second regulating device. Advantageously, the distance between the centers of rotation of the first escape wheel and of the first anchor is substantially equal to the distance between the centers of rotation of the second escape wheel and of the second anchor, and the distance between the centers of rotation of the first anchor and of the first regulating device is substantially equal to the distance between the centers of rotation of the second anchor and of the second regulating device.

In an advantageous embodiment of the method according to the invention, only the regulating device and the escapement are changed in the horological movement.

Figure 2:
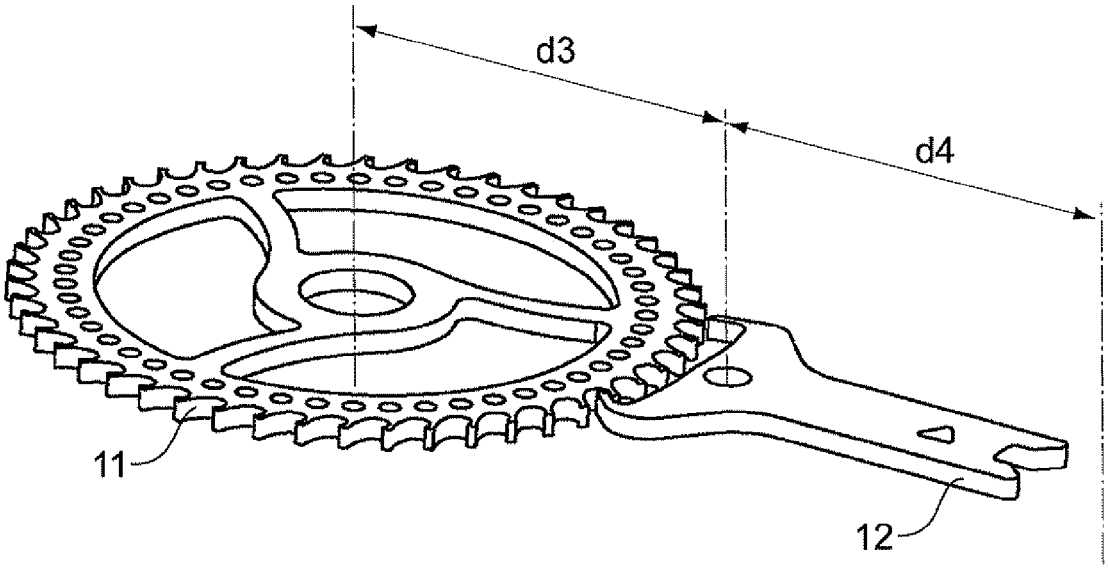
Figure 3:
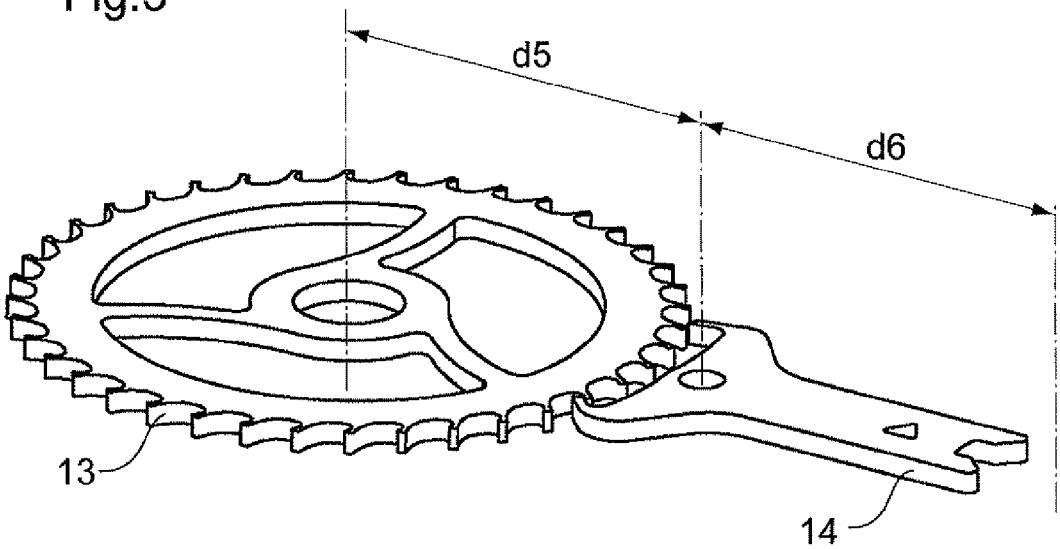

Other characteristics and advantages of the present invention wilt become apparent when reading the following detailed description given while referring to the annexed drawings where:

FIG. 1 is a schematic plan top view of part of a conventional horological movement, FIG. 2 is a perspective view of an escape wheel and an escape anchor according to a first embodiment of the invention, cooperating with each other, FIG. 3 is a perspective view of an escape wheel and an escape anchor according to a second embodiment of the invention, cooperating with each other.

Within the framework of the present invention, by "tooth" is meant a tooth of the escape wheel that is functional, i.e. that cooperates with the anchor pallets in the case of a Swiss anchor (lever) escapement.

Referring to FIG. 1, a conventional horological movement 1 comprises notably a motor spring (not represented) that is housed in a barrel 2, a wheelwork 3 driven by barrel 2, a sprung balance-type regulating device 4 (of which only the balance is represented), and between wheelwork 3 and sprung balance 4 an escapement 5. The escapement 5 comprises an escape wheel 6 and an escape pinion 7 that is rigidly connected with wheel 6 and that is engaged with a seconds wheel 8 of wheelwork 3 to drive the wheel 6. Escapement 5 further comprises an element 9, such as an anchor, cooperating with the escape wheel 6 and with a roller pin 10 rigidly connected with the arbor of sprung balance 4 so as to maintain the oscillations of sprung balance 4. The respective arbors of certain wheels of wheelwork 3, namely the seconds wheel 8, a minutes wheel and an hours wheel (not represented), are intended to hold indicator elements, typically hands, moving above a watch dial, for indicating the seconds, minutes, and hours. All these elements are well known to one skilled in the art, and thus will not be described in further detail.

A known way to increase the oscillation frequency of a sprung balance consists in increasing the stiffness of the balance spring and/or reducing the moment of inertia of the balance. The stiffness of the balance spring may be increased for instance by shortening it or by increasing its cross section. The reduction of the moment of inertia is achieved for instance by making the balance lighter and/or by reducing its radius of gyration.

In the present invention, the increase in frequency of the sprung balance is attended by an increase in the number of teeth of the escape wheel. Current manufacturing techniques allow wheels having a large number of teeth to be realized. FIG. 2 shows an escape wheel 11 and an escape anchor 12 constituting part of an escapement according to a first embodiment of the invention. The escape wheel 11 has 50 teeth, and the escapement including it is intended to work with a sprung balance oscillating at a frequency of 10 Hz (72,000 alternations per hour). FIG. 3 shows an escape wheel 13 and an escape anchor 14 constituting part of an escapement according to a second embodiment of the invention. The escape wheel 13 has 40 teeth, and the escapement including it is intended to work with a sprung balance oscillating at a frequency of 8 Hz (57,600 alternations per hour). In a similar way, one may also realize for instance an escapement having an escape wheel with 30 teeth and intended to work with a sprung balance oscillating at a frequency of 6 Hz (43,200 alternations per hour), or an escapement having an escape wheel with 25 teeth and intended to work with a sprung balance oscillating at a frequency of 5 Hz (36,000 alternations per hour).

It is possible to shape the teeth of the escape wheels so that a same anchor can be used with several of these escape wheels. Thus, anchors 12 and 14 illustrated in FIGS. 2 and 3 can be identical though cooperating with escape wheels that are different.

It is seen that in the above examples, the ratio between the number of teeth of the escape wheel and the frequency of the sprung balance is equal to 5, which is the value that is usually found in current movements. Thus, the angular speed of rotation of the escape wheel is the same as in common movements. It follows that a movement including one of the above escapements and the corresponding sprung balance can have a conventional wheelwork, for example wheelwork 3 illustrated in FIG. 1.

Preferably, the distances of centers of the escapement, that is, the distances between the center of rotation of the escape wheel and the center of rotation of the anchor and between the center of rotation of the anchor and the center of rotation of the balance are preserved from one escapement to another and have conventional values. Thus, in particular, the distance of centers d3 between escape wheel 11 and anchor 12 is equal to the distance of centers d5 between escape wheel 13 and anchor 14 and to the distance of centers d1 between the conventional escape wheel 6 and the conventional anchor 9. Similarly, the distance of centers d4 between anchor 12 and the corresponding balance is equal to the distance of centers d6 between anchor 14 and the corresponding balance and to the distance of centers d2 between the conventional anchor 9 and the conventional balance 4. By preserving the distances of centers from one escapement to another, one facilitates the interchangeability of the escapement—regulating device set in a given movement, and one allows movements including respectively escapements such as those described above and the corresponding sprung balances to have identical plates and bridges.

More generally, it is possible to realize movements that are entirely identical except for their escapement and sprung balance, and regulated by oscillations of different frequencies. The fact that the whole portion of the movement other than the escapement and the sprung balance does not change from one movement to another considerably lowers the costs of development, production, and logistics It is for example possible to take up an existing movement and to change therein only the escapement and the sprung balance to increase its regulation frequency.

In the illustrated examples, the escapement according to the invention is a Swiss anchor escapement. However, the present invention could be applied to other types of anchor escapement, and more generally to other types of escapement.

The invention claimed is:

1. A method for realizing at least two horological movements operating at different oscillation frequencies, comprising the steps of:

a) designing a common base for the movements, the common base comprising a wheelwork for connecting a barrel to an escapement in each movement, b) providing a first set comprising a regulating device having an oscillation frequency f1 and an escapement for maintaining the oscillations of the regulating device, the escapement comprising an escape wheel with N1 teeth, c) providing a second set comprising a regulating device having an oscillation frequency f2 and an escapement for maintaining the oscillations of the regulating device, the escapement comprising an escape wheel with N2 teeth, wherein the oscillation frequencies f1 and f2 are different, and the number of teeth N1 and N2 are different and the ratio between N1 and f1 is substantially equal to the ratio between N2 and f2, d) manufacturing a first movement so that the first movement includes a first base according to step a) and the first set, and e) manufacturing a second movement so that the second movement includes a second base according to step a) and the second set.

2. The method according to claim 1, wherein the escapement of each of the first and second sets further comprises an anchor located between the escape wheel and the regulating device, and wherein a first distance between centers of rotation of the escape wheel and of the anchor in said first movement, is substantially the same as a second distance between centers of rotation of the escape wheel and the anchor in said second movement, and wherein a third distance between centers of rotation of the anchor and of the regulating device in said first movement is substantially the same as a fourth distance between centers of rotation of the anchor and of the regulating device in said second movement.

3. The method according to claim 1, wherein said first and said second movements are realized so as to be substantially entirely identical except for their escapement and their regulating device.

4. The method according to claim 1, wherein said ratios between N1 and f1 and between N2 and f2, where f1 and f2 are measured in Hertz, is substantially equal to 5.

5. The method according to claim 1, wherein at least one of the oscillation frequencies f1 and f2 is at least equal to about 5 Hz.

6. The method according to claim 5, wherein said at least one of the oscillation frequencies f1 and f2 is at least equal to about 6 Hz.

7. The method according to claim 6, wherein said at least one of the oscillation frequencies f1 and f2 is at least equal to about 8 Hz.

8. The method according to claim 7, wherein said at least one of the oscillation frequencies f1 and f2 is at least equal to about 10 Hz.

* * * * *